US008365872B2

(12) United States Patent
Ueda

(10) Patent No.: US 8,365,872 B2
(45) Date of Patent: Feb. 5, 2013

(54) ELEVATOR DEVICE HAVING THE PLURALITY OF HOISTING MACHINES

(75) Inventor: Takaharu Ueda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 288 days.

(21) Appl. No.: 12/812,609

(22) PCT Filed: Apr. 15, 2008

(86) PCT No.: PCT/JP2008/057325

§ 371 (c)(1),
(2), (4) Date: Jul. 13, 2010

(87) PCT Pub. No.: WO2009/128139

PCT Pub. Date: Oct. 22, 2009

(65) Prior Publication Data

US 2010/0282545 A1 Nov. 11, 2010

(51) Int. Cl.
*B66B 1/34* (2006.01)

(52) U.S. Cl. ..... 187/393; 187/288; 187/248

(58) Field of Classification Search ..... 187/247, 187/248, 277, 288, 289, 293, 391–393
See application file for complete search history.

(56) References Cited

U.S. PATENT DOCUMENTS

| | | | | |
|---|---|---|---|---|
| 4,350,225 | A * | 9/1982 | Sakata et al. | 187/248 |
| 7,344,003 | B2 * | 3/2008 | Kimura et al. | 187/256 |
| 7,559,407 | B2 * | 7/2009 | Siikonen et al. | 187/382 |
| 7,669,697 | B2 | 3/2010 | Ueda et al. | |
| 7,730,998 | B2 | 6/2010 | Takahashi et al. | |
| 7,748,502 | B2 * | 7/2010 | Ueda et al. | 187/293 |
| 7,770,698 | B2 | 8/2010 | Okamoto et al. | |
| 7,896,135 | B2 * | 3/2011 | Kattainen et al. | 187/248 |
| 7,931,127 | B2 * | 4/2011 | Kondo et al. | 187/288 |
| 7,938,231 | B2 * | 5/2011 | Ueda et al. | 187/288 |
| 8,096,387 | B2 * | 1/2012 | Kattainen et al. | 187/248 |
| 8,205,721 | B2 * | 6/2012 | Korhonen et al. | 187/288 |
| 2007/0284196 | A1 | 12/2007 | Sakai et al. | |
| 2009/0229924 | A1 | 9/2009 | Kondo et al. | |
| 2009/0255764 | A1 | 10/2009 | Ueda et al. | |
| 2010/0025162 | A1 | 2/2010 | Okamoto et al. | |
| 2010/0032245 | A1 | 2/2010 | Shibata et al. | |
| 2010/0101896 | A1 | 4/2010 | Ueda et al. | |
| 2010/0101897 | A1 | 4/2010 | Hashimoto et al. | |

FOREIGN PATENT DOCUMENTS

| | | |
|---|---|---|
| JP | 2005 343602 | 12/2005 |
| JP | 2006 315794 | 11/2006 |
| JP | 2007-084174 | 4/2007 |
| WO | 2007 023550 | 3/2007 |
| WO | 2007 060733 | 5/2007 |
| WO | 2008 012896 | 1/2008 |

* cited by examiner

OTHER PUBLICATIONS

Chinese Office Action dated Nov. 1, 2012, in a counterpart foreign application, with English translation.

*Primary Examiner* — Anthony Salata
(74) *Attorney, Agent, or Firm* — Oblon, Spivak, McClelland, Maier & Neustadt, L.L.P.

(57) ABSTRACT

In an elevator device, a car is raised and lowered by a plurality of hoisting machines respectively including hoisting machine brakes. Each of the hoisting machine brakes has a braking force large enough to stop the car by itself. Each of a plurality of brake control sections respectively for controlling the corresponding hoisting machine brakes includes a plurality of calculation sections. The calculation sections can detect a failure of the calculation sections by comparing own results of calculations and cause a corresponding one of the hoisting machine brakes to perform a braking operation upon detection of the failure of the calculation sections.

5 Claims, 5 Drawing Sheets

ELEVATOR DEVICE HAVING THE PLURALITY OF HOISTING MACHINES

TECHNICAL FIELD

The present invention relates to an elevator device which raises and lowers a car by a plurality of hoisting machines.

BACKGROUND ART

In a conventional elevator device, a car is raised and lowered by a first hoisting machine including a first brake device and a second hoisting machine including a second brake device. The first brake device includes first, second, and third brake main bodies. The second brake device includes fourth, fifth, and sixth brake main bodies. The first and fourth brake main bodies belong to a first group, the second and fifth brake main bodies belong to a second group, and the third and sixth brake main bodies belong to a third group. For emergency braking, timings of generation of braking forces by the first to sixth brake main bodies are shifted for each group, whereby the car can be prevented from being subjected to an excessive deceleration rate (for example, see Patent Document 1).

DISCLOSURE OF THE INVENTION

Problem to be Solved by the Invention

When the first and second brake devices are to be controlled by a plurality of calculation sections in the elevator device in which the common car is raised and lowered by the first and second hoisting machines as described above, it is desired to more reliably stop the car even when a failure occurs in the calculation sections.

The present invention is devised to solve the problem described above, and has an object of providing an elevator device which can more reliably stop a car even when a failure occurs in calculation sections.

Means for Solving the Problem

According to the present invention, there is provided an elevator device including: a plurality of hoisting machines including driving sheaves, motors for rotating the driving sheaves, and hoisting machine brakes for braking rotation of the driving sheaves, respectively; suspending means wound around the driving sheaves; a car suspended by the suspending means, the car being raised and lowered by the plurality of hoisting machines; and a plurality of brake control sections for controlling the corresponding hoisting machine brakes, respectively, in which each of the hoisting machine brakes has a braking force large enough to stop the car by itself, each of the plurality of brake control sections includes a plurality of calculation sections, and the plurality of calculation sections are capable of detecting a failure of the plurality of calculation sections by comparing own results of calculations and cause a corresponding one of the hoisting machine brakes to perform a braking operation upon detection of the failure of the plurality of calculation sections.

Further, according to the present invention, there is provided an elevator device including: a first hoisting machine including a first driving sheave, a first motor for rotating the first driving sheave, and a first brake device and a second brake device for braking rotation of the first driving sheave; a second hoisting machine including a second driving sheave, a second motor for rotating the second driving sheave, and a third brake device and a fourth brake device for braking rotation of the second driving sheave; suspending means wound around the first driving sheave and the second driving sheave; a car suspended by the suspending means, the car being raised and lowered by the first hoisting machine and the second hoisting machine; a first brake control section for controlling the second brake device and the third brake device; and a second brake control section for controlling the first brake device and the fourth brake device, in which each of a set of the second brake device and the third brake device and a set of the first brake device and the fourth brake device has a braking force large enough to stop the car by itself, each of the first brake control section and the second brake control section includes a plurality of calculation sections, the plurality of calculation sections are capable of detecting a failure of the plurality of calculation sections by comparing own results of calculations, the first brake control section causes the second brake device and the third brake device to perform a braking operation upon detection of a failure of the plurality of calculation sections, and the second brake control section causes the first brake device and the fourth brake device to perform a braking operation upon detection of a failure of the plurality of calculation sections.

Further, according to the present invention, there is provided an elevator device including: a plurality of hoisting machines including driving sheaves, motors for rotating the driving sheaves, and hoisting machine brakes for braking rotation of the driving sheaves, respectively; suspending means wound around the driving sheaves; a car suspended by the suspending means, the car being raised and lowered by the plurality of hoisting machines; and a plurality of brake control sections for controlling the corresponding hoisting machine brakes, respectively, in which each of the plurality of brake control sections includes a plurality of calculation sections, and the plurality of calculation sections are capable of detecting a failure of the plurality of calculation sections by comparing own results of calculations and cause all of the hoisting machine brakes to perform a braking operation upon detection of the failure of the plurality of calculation sections.

BEST MODE FOR CARRYING OUT THE INVENTION

Figure 1:
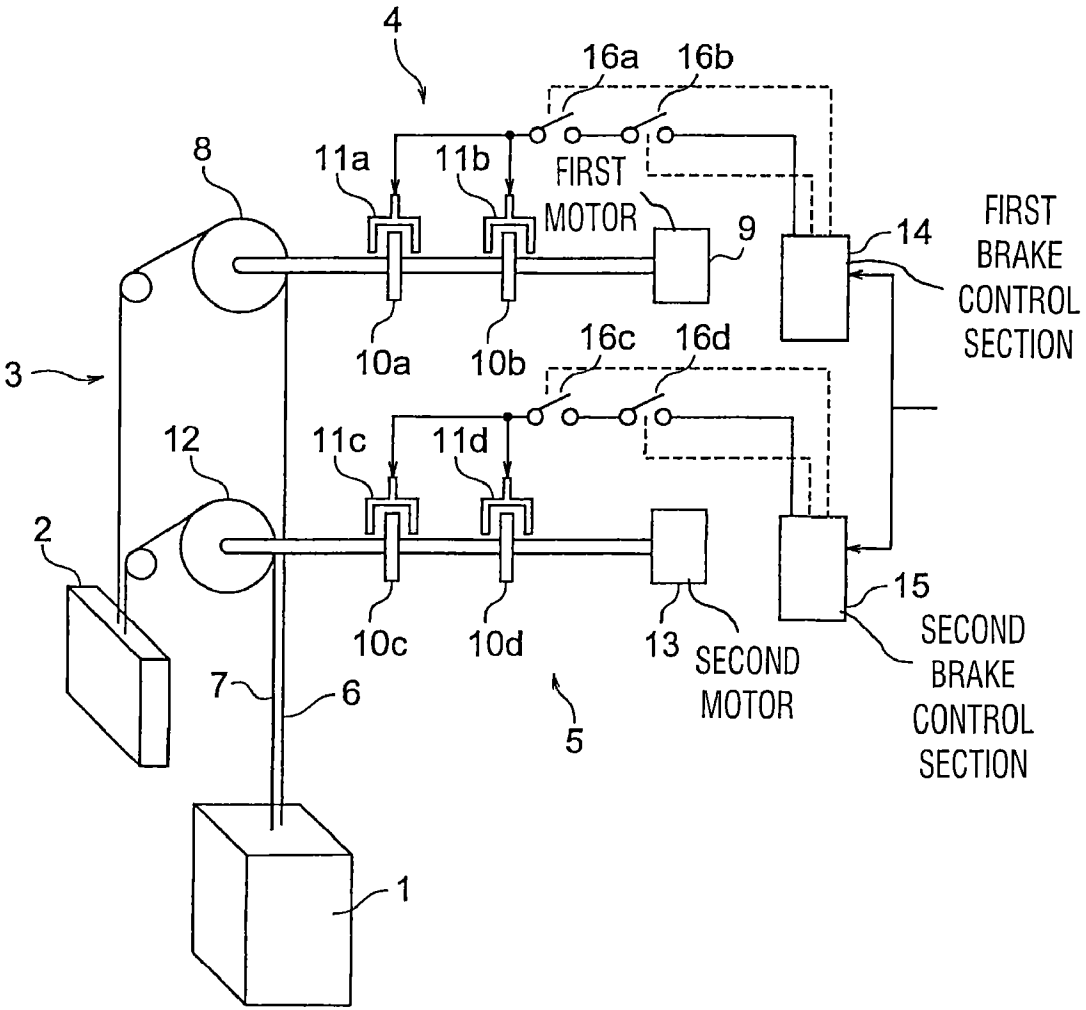
FIG. 1 is a configuration diagram illustrating an elevator device according to a first embodiment of the present invention.

Hereinafter, preferred embodiments of the present invention are described referring to the drawings.

First Embodiment

FIG. 1 is a configuration diagram illustrating an elevator device according to a first embodiment of the present invention. In the drawing, a car 1 and a counterweight 2 are suspended by suspending means 3 in a hoistway, and are raised and lowered by driving forces of a first hoisting machine 4 and a second hoisting machine 5. The suspending means 3 includes at least one first main rope 6 and at least one second main rope 7. As each of the first main rope 6 and the second main rope 7, a rope having a circular cross section or a belt-like rope is used.

The first hoisting machine 4 includes: a first driving sheave 8; a first motor 9 for rotating the first driving sheave 8; a first brake wheel 10*a* and a second brake wheel 10*b* which are rotated integrally with the first driving sheave 8; and a first brake device 11*a* and a second brake device 11*b* for respectively braking the rotation of the first brake wheel 10*a* and that of the second brake wheel 10*b*.

The second hoisting machine 5 includes: a second driving sheave 12; a second motor 13 for rotating the second driving sheave 12; a third brake wheel 10*c* and a fourth brake wheel 10*d* which are rotated integrally with the second driving sheave 12; and a third brake device 11*c* and a fourth brake device 11*d* for respectively braking the rotation of the third brake wheel 10*c* and that of the fourth brake wheel 10*d*.

A first hoisting machine brake for braking the rotation of the first driving sheave 8 includes the first brake device 11*a* and the second brake device 11*b*. A second hoisting machine brake for braking the rotation of the second driving sheave 12 includes the third brake device 11*b* and the fourth brake device 11*d*. The first hoisting machine brake has a braking force large enough to stop the car 1 by itself. The second hoisting machine brake has a braking force large enough to stop the car 1 by itself.

Each of the brake devices 11*a*, 11*b*, 11*c*, and 11*d* includes: a brake shoe moved into contact with and separated away from a corresponding one of the brake wheels 10*a*, 10*b*, 10*c*, and 10*d*; a brake spring for pressing the brake shoe against the corresponding one of the brake wheels 10*a*, 10*b*, 10*c*, and 10*d*; and an electromagnet for separating the brake shoe from the corresponding one of the brake wheels 10*a*, 10*b*, 10*c*, and 10*d* against the brake spring. As the brake wheels 10*a*, 10*b*, 10*c*, and 10*d*, brake discs are used, for example.

The first brake device 11*a* and the second brake device 11*b* are controlled by a first brake control section 14. The third brake device 11*c* and the fourth brake device 11*d* are controlled by a second brake control section 15. The first brake control section 14 controls opening/closing of a first electromagnetic switch 16*a* and a second electromagnetic switch 16*b* for turning ON/OFF electric power supply to the electromagnets of the first brake device 11*a* and the second brake device 11*b*. The second brake control section 15 controls opening/closing of a third electromagnetic switch 16*c* and a fourth electromagnetic switch 16*d* for turning ON/OFF electric power supply to the electromagnets of the third brake device 11*c* and the fourth brake device 11*d*.

Figure 2:
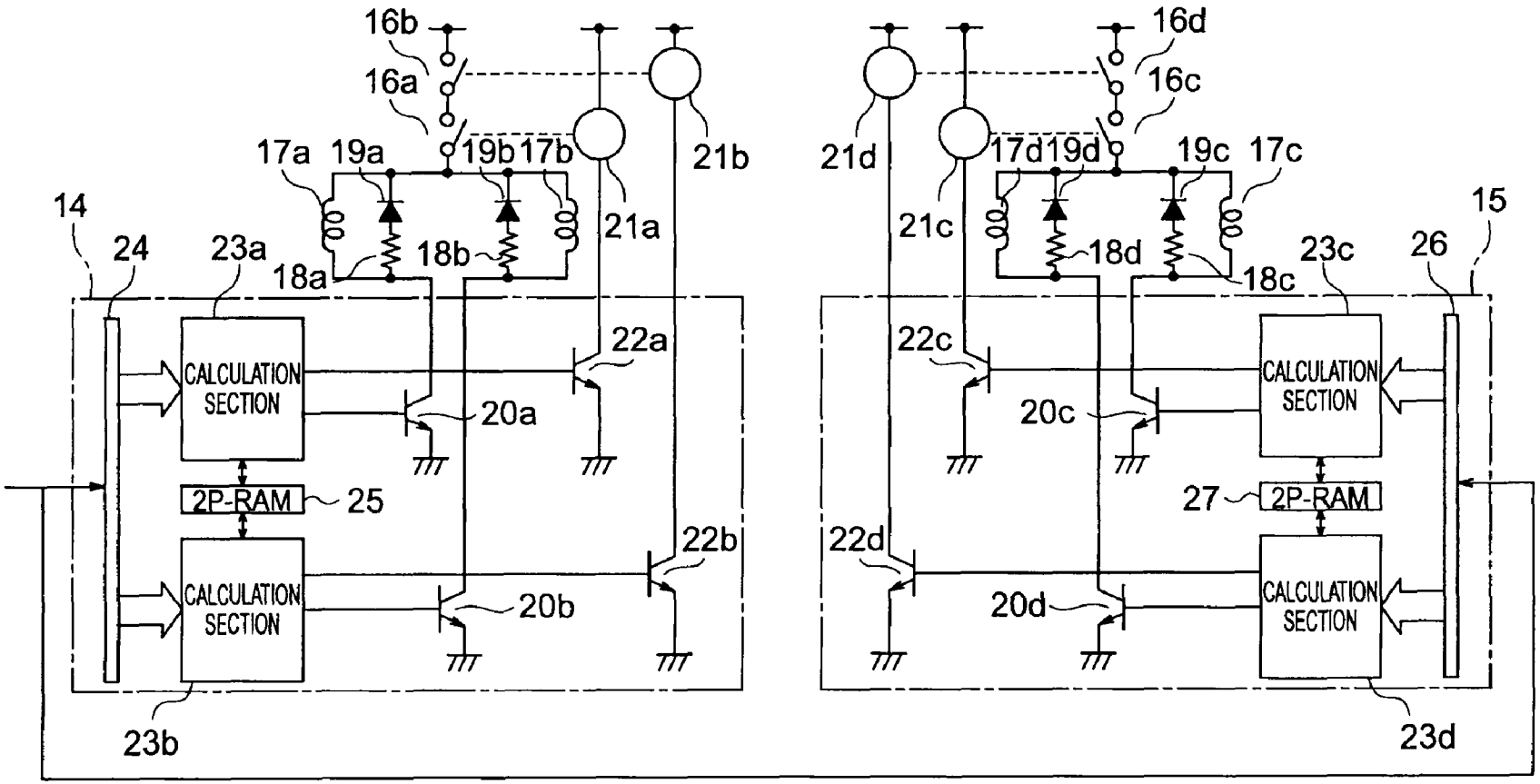
FIG. 2 is a circuit diagram illustrating a principal part of the elevator device illustrated in FIG. 1.

FIG. 2 is a circuit diagram illustrating a principal part of the elevator device illustrated in FIG. 1.

First, a circuit configuration relating to the first brake control section 14 is described. A first brake coil (a first electromagnetic coil) 17*a* is provided to the electromagnet of the first brake device 11*a*. A second brake coil (a second electromagnetic coil) 17*b* is provided to the electromagnet of the second brake device 11*b*.

The first brake coil 17*a* and the second brake coil 17*b* are connected in parallel to a power source. The first electromagnetic switch 16*a* and the second electromagnetic switch 16*b* are connected in series between the first brake coil 17*a* and the second brake coil 17*b*, and the power source.

A circuit, in which a first discharge resistor 18*a* and a first discharge diode 19*a* are connected in series, is connected in parallel to the first brake coil 17*a*. A circuit, in which a second discharge resistor 18*b* and a second discharge diode 19*b* are connected in series, is connected in parallel to the second brake coil 17*b*.

A first braking-force control switch 20*a* is connected between the first brake coil 17*a* and a ground. A second braking-force control switch 20*b* is connected between the second brake coil 17*a* and the ground. As the first braking-force control switch 20*a* and the second braking-force control switch 20*b*, semiconductor switches are used, for example.

By turning ON/OFF the first braking-force control switch 20*a* and the second braking-force control switch 20*b*, currents flowing respectively through the first brake coil 17*a* and the second brake coil 17*b* are controlled to control the degrees of application of the braking forces of the first brake device 11*a* and the second brake device 11*b*, respectively.

The first electromagnetic switch 16*a* is opened and closed by a first driving coil 21*a*. An end of the first driving coil 21*a* is connected to a power source. The other end of the first driving coil 21*a* is connected to the ground through an intermediation of a first electromagnetic-switch control switch 22*a*.

The second electromagnetic switch 16*b* is opened and closed by a second driving coil 21*b*. An end of the second driving coil 21*b* is connected to a power source. The other end of the second driving coil 21*b* is connected to the ground through an intermediation of a second electromagnetic-switch control switch 22*b*. As the first electromagnetic-switch control switch 22*a* and the second electromagnetic-switch control switch 22*b*, semiconductor switches are used, for example.

The first braking-force control switch 20*a* and the first electromagnetic-switch control switch 22*a* are controlled to be turned ON/OFF by a first calculation section (a first computer) 23*a*. The second braking-force control switch 20*b* and the second electromagnetic-switch control switch 22*b* are controlled to be turned ON/OFF by a second calculation section (a second computer) 23*b*. Each of the first calculation section 23*a* and the second calculation section 23*b* includes a microcomputer.

Signals from various sensors and an operation control section are input to the first calculation section 23*a* and the second calculation section 23*b* through a data bus 24. The first calculation section 23*a* and the second calculation section 23*b* perform calculation processing for controlling the first brake device 11*a* and the second brake device 11*b* based on programs stored therein and the input signals.

Moreover, a dual-port RAM 25 is connected between the first calculation section 23*a* and the second calculation section 23*b*. The first calculation section 23*a* and the second calculation section 23*b* exchange their own data through the dual-port RAM 25 to compare the results of calculations with each other, thereby detecting the occurrence of a failure in any one of the first calculation section 23*a* an the second calculation section 23*b*.

Next, a circuit configuration relating to the second brake control section 15 is described. A third brake coil (a third electromagnetic coil) 17*c* is provided to the electromagnet of the third brake device 11*c*. A fourth brake coil (a fourth electromagnetic coil) 17*d* is provided to the electromagnet of the fourth brake device 11*d*.

The third brake coil 17*c* and the fourth brake coil 17*d* are connected in parallel to a power source. The third electromagnetic switch 16*c* and the fourth electromagnetic switch 16*d* are connected in series between the third brake coil 17*c* and the fourth brake coil 17*d*, and the power source.

A circuit, in which a third discharge resistor 18*c* and a third discharge diode 19*c* are connected in series, is connected in parallel to the third brake coil 17*c*. A circuit, in which a fourth discharge resistor 18*d* and a fourth discharge diode 19*d* are connected in series, is connected in parallel to the fourth brake coil 17*d*.

A third braking-force control switch 20*c* is connected between the third brake coil 17*c* and a ground. A fourth braking-force control switch 20*d* is connected between the fourth brake coil 17*d* and the ground. As the third braking-force control switch 20*c* and the fourth braking-force control switch 20*d*, semiconductor switches are used, for example.

By turning ON/OFF the third braking-force control switch 20*c* and the fourth braking-force control switch 20*d*, currents flowing respectively through the third brake coil 17*c* and the fourth brake coil 17*d* are controlled to control the degrees of application of the braking forces of the third brake device 11*c* and the fourth brake device 11*d*, respectively.

The third electromagnetic switch 16*c* is opened and closed by a third driving coil 21*c*. An end of the third driving coil 21*c* is connected to a power source. The other end of the third driving coil 21*c* is connected to the ground through an intermediation of a third electromagnetic-switch control switch 22*c*.

The fourth electromagnetic switch 16*d* is opened and closed by a fourth driving coil 21*d*. An end of the fourth driving coil 21*d* is connected to a power source. The other end of the fourth driving coil 21*d* is connected to the ground through an intermediation of a fourth electromagnetic-switch control switch 22*d*. As the third electromagnetic-switch control switch 22*c* and the fourth electromagnetic-switch control switch 22*d*, semiconductor switches are used, for example.

The third braking-force control switch 20*c* and the third electromagnetic-switch control switch 22*c* are controlled to be turned ON/OFF by a third calculation section (a third computer) 23*c*. The fourth braking-force control switch 20*d* and the fourth electromagnetic-switch control switch 22*d* are controlled to be turned ON/OFF by a fourth calculation section (a fourth computer) 23*d*. Each of the third calculation section 23*c* and the fourth calculation section 23*d* includes a microcomputer.

Signals from various sensors and an operation control section are input to the third calculation section 23*c* and the fourth calculation section 23*d* through a data bus 26. The third calculation section 23*c* and the fourth calculation section 23*d* perform calculation processing for controlling the third brake device 11*c* and the fourth brake device 11*d* based on programs stored therein and the input signals.

Moreover, a dual-port RAM 27 is connected between the third calculation section 23*c* and the fourth calculation section 23*d*. The third calculation section 23*c* and the fourth calculation section 23*d* exchange their own data through the dual-port RAM 27 to compare the results of calculations with each other, thereby detecting the occurrence of a failure in any one of the third calculation section 23*c* an the fourth calculation section 23*d*.

Next, an operation of the first brake control section 14 is described. The operation control section transmits a brake operation command to the first brake control section 14 according to start/stop of the car 1. Upon issuance of the brake operation command, the first calculation section 23*a* and the second calculation section 23*b* respectively turn ON the first electromagnetic-switch control switch 22*a* and the second electromagnetic-switch control switch 22*b*. As a result, the first driving coil 21*a* and the second driving coil 21*b* are excited to close the first electromagnetic switch 16*a* and the second electromagnetic switch 16*b*.

By turning ON/OFF the first braking-force control switch 20*a* and the second braking-force control switch 20*b* in this state, the excited states of the first brake coil 17*a* and the second brake coil 17*b* are controlled to control the braking states of the first brake device 11*a* and the second brake device 11*b*. Moreover, the first calculation section 23*a* and the second calculation section 23*b* apply a control command, for example, a command for continuous ON/OFF according to a required current, to the first braking-force control switch 20*a* and the second braking-force control switch 20*b*.

In case of an emergency stop of the car 1, the first calculation section 23*a* and the second calculation section 23*b* control the currents of the first brake coil 17*a* and the second brake coil 17*b* by ON/OFF of the braking-force control switches 20*a* and 20*b* while referring to a signal from a speed detection section (not shown) so that a rotating speed of the first driving sheave 8, that is, a speed of the car 1 follows a target speed pattern. A deceleration pattern is set so that a deceleration rate does not become excessively high.

Moreover, when the results of calculations by the first calculation section 23*a* and the second calculation section 23*b* differ from each other, it is believed that at least any one of the first calculation section 23*a* and the second calculation section 23*b* has failed. Therefore, the first calculation section 23*a* generates a command for opening the first electromagnetic switch 16*a*, and the second calculation section 23*b* generates a command for opening the second electromagnetic switch 16*b*. As a result of opening of at least any one of the first electromagnetic switch 16*a* and the second electromagnetic switch 16*b*, the first brake device 11*a* and the second brake device 11*b* immediately perform a braking operation without controlling the deceleration rate.

Next, an operation of the second brake control section 15 is described. The operation control section transmits a brake operation command to the first brake control section 15 according to start/stop of the car 1. Upon issuance of the brake operation command, the third calculation section 23*c* and the fourth calculation section 23*d* respectively turn ON the third electromagnetic-switch control switch 22*c* and the fourth electromagnetic-switch control switch 22*d*. As a result, the third driving coil 21*c* and the fourth driving coil 21*d* are excited to close the third electromagnetic switch 16*c* and the fourth electromagnetic switch 16*d*.

By turning ON/OFF the third braking-force control switch 20*c* and the fourth braking-force control switch 20*d* in this state, the excited states of the third brake coil 17*c* and the fourth brake coil 17*d* are controlled to control the braking states of the third brake device 11*c* and the fourth brake device 11*d*. Moreover, the third calculation section 23*c* and the fourth calculation section 23*d* apply a control command, for example, a command for continuous ON/OFF according to a required current, to the third braking-force control switch 20*c* and the fourth braking-force control switch 20*d*.

In case of an emergency stop of the car 1, the third calculation section 23*c* and the fourth calculation section 23*d* control the currents of the third brake coil 17*c* and the fourth brake coil 17*d* by ON/OFF of the braking-force control switches 20*c* and 20*d* while referring to a signal from a speed detection section so that a rotating speed of the second driving sheave 12, that is, a speed of the car 1 follows a target speed pattern. A deceleration pattern is set so that a deceleration rate does not become excessively high.

Moreover, when the results of calculations by the third calculation section 23*c* and the fourth calculation section 23*d* differ from each other, it is believed that at least any one of the third calculation section 23*c* and the fourth calculation section 23*d* has failed. Therefore, the third calculation section 23*c* generates a command for opening the third electromagnetic switch 16*c*, and the fourth calculation section 23*d* generates a command for opening the fourth electromagnetic switch 16*d*. As a result of opening of at least any one of the third electromagnetic switch 16*c* and the fourth electromagnetic switch 16*d*, the third brake device 11*c* and the fourth brake device 11*d* immediately perform a braking operation without controlling the deceleration rate.

In the elevator device as described above, each of the first and second hoisting machine brakes has the braking force large enough to stop the car 1 by itself. Upon detection of the failure of any one of the calculation sections 23*a*, 23*b*, 23*c*, and 23*d*, the first brake control section 14 and the second brake control section 15 cause the corresponding hoisting machine brake to perform the braking operation. Thus, even when the failure occurs in the calculation sections 23*a*, 23*b*, 23*c*, and 23*d*, the car 1 can be more reliably stopped.

Second Embodiment

Figure 3:
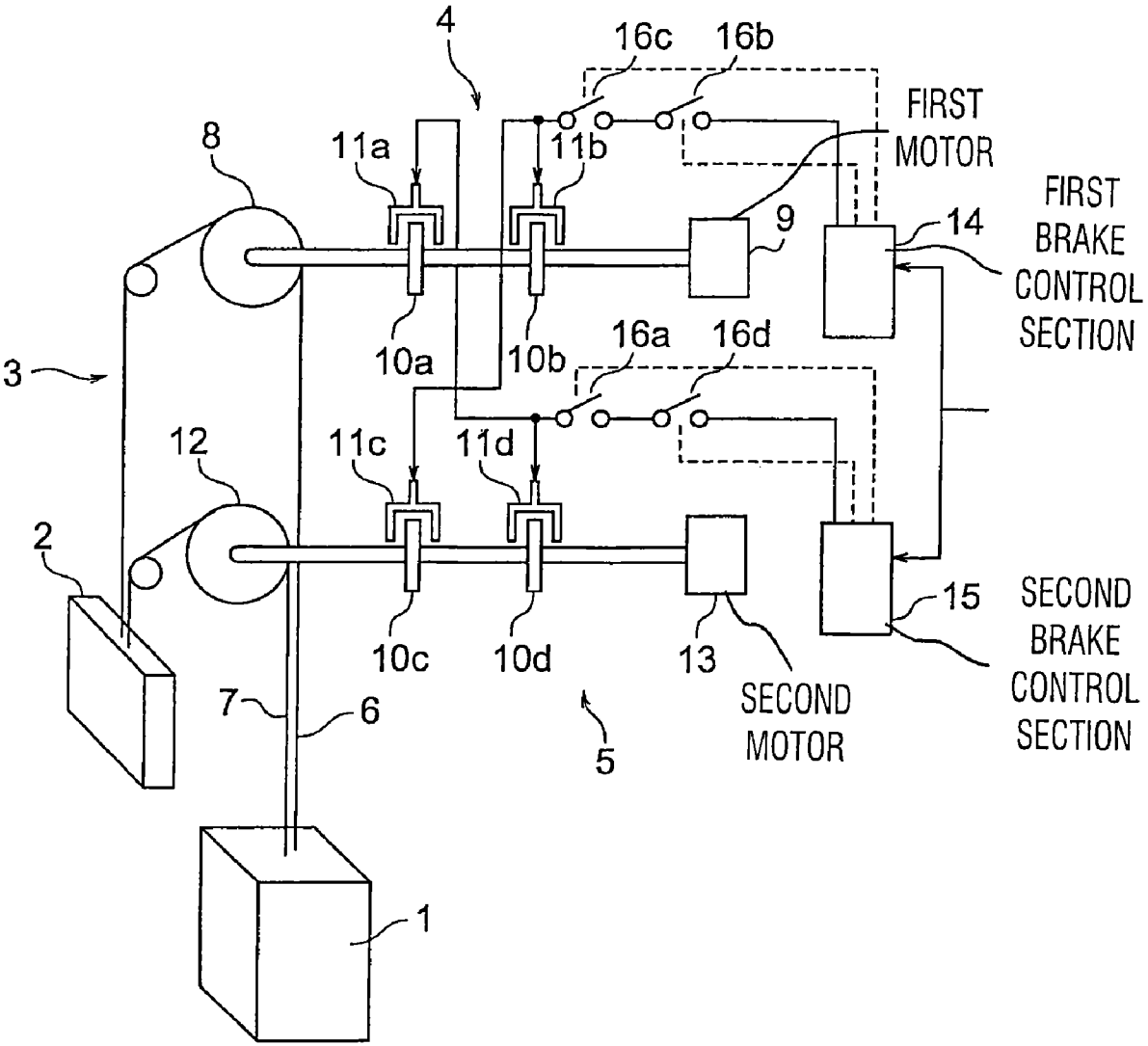
FIG. 3 is a configuration diagram illustrating the elevator device according to a second embodiment of the present invention.

Next, FIG. 3 is a configuration diagram illustrating the elevator device according to a second embodiment of the present invention. In the drawing, each of a set of the second brake device 11*b* and the third brake device 11*c* and a set of the first brake device 11*a* and the fourth brake device 11*d* has the braking force large enough to stop the car 1 by itself. Upon detection of a failure of any one of the first calculation section 23*a* and the second calculation section 23*b*, the first brake control section 14 causes the second brake device 11*b* and the third brake device 11*c* to perform the braking operation. Upon detection of a failure of any one of the third calculation section 23*c* and the fourth calculation section 23*d*, the second brake control section 15 causes the first brake device 11*a* and the fourth brake device 11*b* to perform the braking operation.

Specifically, the configuration is obtained by interchanging the first driving coil 21*a* for opening and closing the first electromagnetic switch 16*a* and the third driving coil 21*c* for opening and closing the third electromagnetic switch 16*c* with each other in FIG. 2. Substantially, the configuration is the same as a configuration in which the first brake device 11*a* and the third brake device 11*c* illustrated in FIG. 1 are interchanged with each other in the circuit configuration illustrated in FIG. 2. The remaining configuration and operation are the same as those of the first embodiment.

In the elevator device as described above, even when the failure occurs in the calculation sections 23*a*, 23*b*, 23*c*, and 23*d*, the car 1 can be more reliably stopped.

Furthermore, upon detection of the failure of the calculation sections 23*a*, 23*b*, 23*c*, and 23*d*, the braking force is applied to both the first driving sheave 8 and the second driving sheave 12. Therefore, the imbalance of the braking force can be suppressed, and hence the car 1 can be stably stopped.

Third Embodiment

Figure 4:
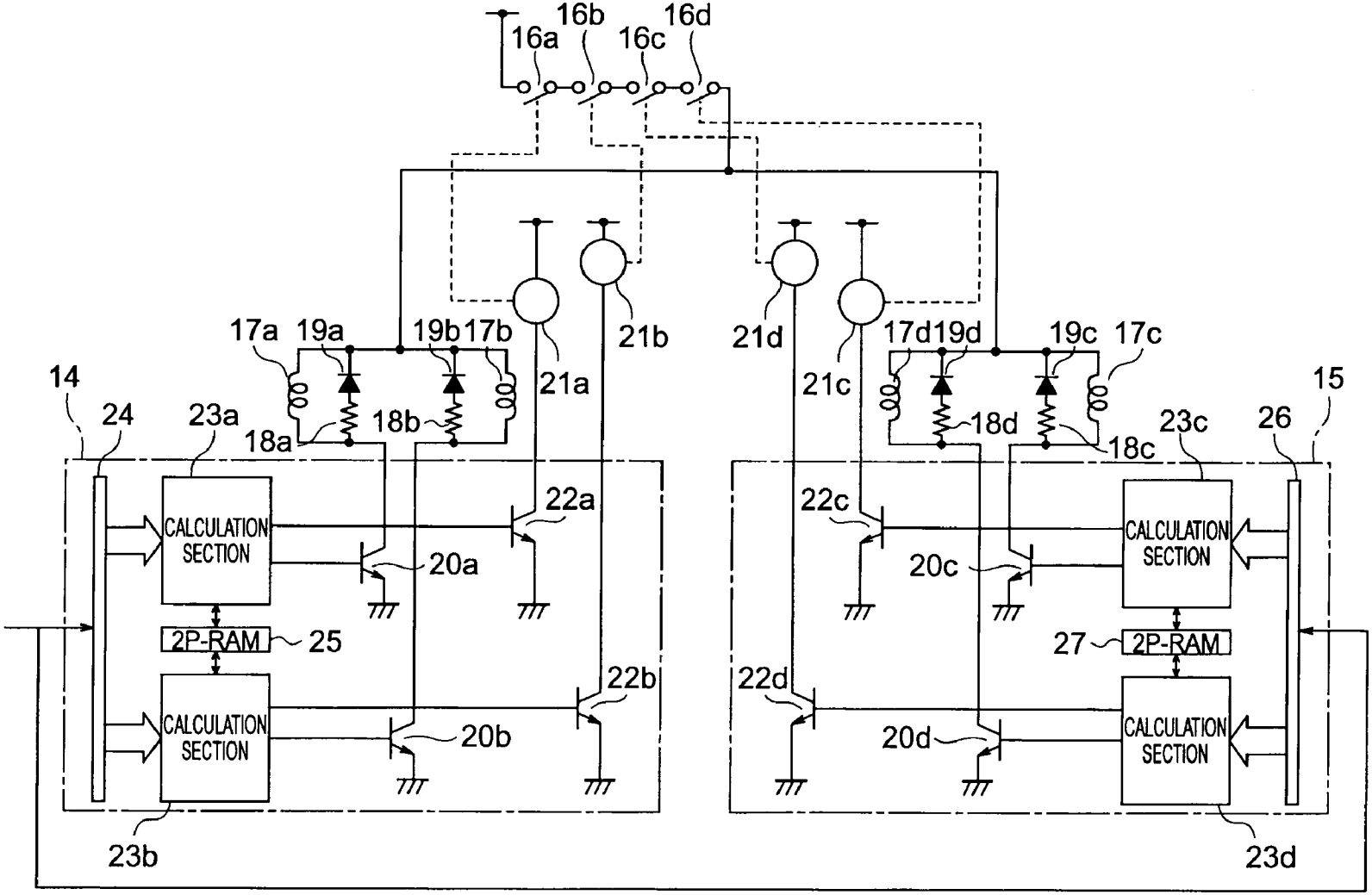
FIG. 4 is a circuit diagram illustrating the principal part of the elevator device according to a third embodiment of the present invention.

Next, FIG. 4 is a circuit diagram illustrating the principal part of the elevator device according to a third embodiment of the present invention. In the drawing, the first to fourth electromagnetic switches 16*a* to 16*d* are connected in series between the first to fourth brake coils 17*a* to 17*d* and the power source. Therefore, when any one of the electromagnetic switches 16*a* to 16*d* is opened, all the brake devices 11*a*, 11*b*, 11*c*, and 11*d* are de-energized. The remaining configuration and operation are the same as those of the first embodiment.

In the elevator device described above, when the failure occurs in the calculation sections 23*a*, 23*b*, 23*c*, and 23*d*, all the brake devices 11*a*, 11*b*, 11*c*, and 11*d* are de-energized. Thus, the car 1 can be more reliably stopped. Furthermore, the braking force (a braking torque) of each of the brake devices 11*a*, 11*b*, 11*c*, and 11*d* can be made smaller than that of each of the first and second embodiments.

Fourth Embodiment

Figure 5:
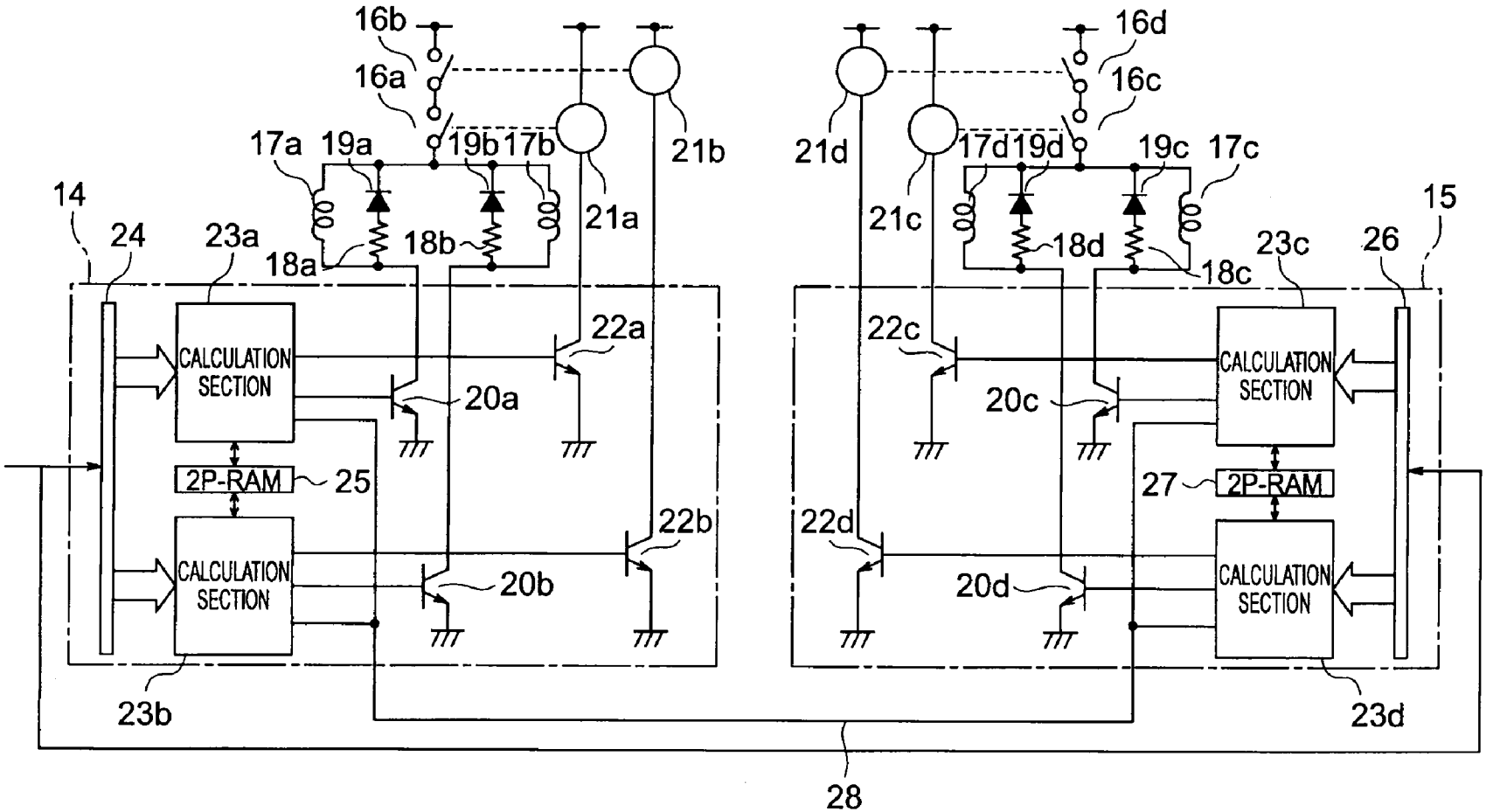
FIG. 5 is a circuit diagram illustrating the principal part of the elevator device according to a fourth embodiment of the present invention.

Next, FIG. 5 is a circuit diagram illustrating the principal part of the elevator device according to a fourth embodiment of the present invention. In the drawing, the first calculation section 23*a* and the second calculation section 23*b*, and the third calculation section 23*c* and the fourth calculation section 23*d* are connected to each other through communication means 28 so that communication can be performed therebetween.

Upon detection of the failure of the first calculation section 23*a* and the second calculation section 23*b*, the first calculation section 23*a* generates a command for opening the first electromagnetic switch 16*a* and the second calculation section 23*b* generates command for opening the second electromagnetic switch 16*b* while transmitting failure detection information to the first calculation section 23*c* and the fourth calculation section 23*d* through the communication means 28. As a result, the first calculation section 23*c* generates a command for opening the third electromagnetic switch 16*c*, and the fourth calculation section 23*d* generates a command for opening the fourth electromagnetic switch 16*d*.

Upon detection of the failure of the third calculation section 23*c* and the fourth calculation section 23*d*, the third calculation section 23*c* generates a command for opening the third electromagnetic switch 16*c* and the fourth calculation section 23*d* generates command for opening the fourth electromagnetic switch 16*d* while transmitting failure detection information to the first calculation section 23*a* and the second calculation section 23*b* through the communication means 28. As a result, the first calculation section 23*a* generates a command for opening the first electromagnetic switch 16*a*, and the second calculation section 23*b* generates a command for opening the second electromagnetic switch 16*b*. The remaining configuration and operation are the same as those of the first embodiment.

In the elevator device described above, when the failure occurs in the calculation sections 23*a*, 23*b*, 23*c*, and 23*d*, all the brake devices 11*a*, 11*b*, 11*c*, and 11*d* are de-energized. Thus, the car 1 can be more reliably stopped. Furthermore, the braking force (a braking torque) of each of the brake devices 11*a*, 11*b*, 11*c*, and 11*d* can be made smaller than that of each of the first and second embodiments.

Furthermore, each of the electromagnetic switches 16*a* to 16*d* is required to be used to function for the electric power supplied to each of all the brake coils 17*a* to 17*d* in the third embodiment, and hence the device cannot be reduced in size. On the other hand, it is sufficient that each of the electromagnetic switches is used to function for the electric power supplied to either one of sets of two of the brake coils 17*a* to 17*d* in the fourth embodiment, and hence the device can be relatively reduced in size.

Although the car 1 is raised and lowered by the two hoisting machines 4 and 5 in the examples described above, three or more hoisting machines may also be used.

Moreover, although the set of the two brake devices 11*a* and 11*b* and the set of the two brake devices 11*c* and 11*d* are respectively used for the hoisting machines 4 and 5 in the examples described above, one, three or more brake devices may also be used.

The invention claimed is:

1. An elevator device comprising:

a plurality of hoisting machines including driving sheaves, motors for rotating the driving sheaves, and hoisting machine brakes for braking rotation of the driving sheaves, respectively;

suspending means wound around the driving sheaves;

a car suspended by the suspending means, the car being raised and lowered by the plurality of hoisting machines; and a plurality of brake control sections for controlling the corresponding hoisting machine brakes, respectively, wherein each of the hoisting machine brakes has a braking force large enough to stop the car by itself, each of the plurality of brake control sections includes a plurality of calculation sections, and the plurality of calculation sections are capable of detecting a failure of the plurality of calculation sections by comparing own results of calculations and cause a corresponding one of the hoisting machine brakes to perform a braking operation upon detection of the failure of the plurality of calculation sections.

2. An elevator device comprising:

a first hoisting machine including a first driving sheave, a first motor for rotating the first driving sheave, and a first brake device and a second brake device for braking rotation of the first driving sheave;

a second hoisting machine including a second driving sheave, a second motor for rotating the second driving sheave, and a third brake device and a fourth brake device for braking rotation of the second driving sheave;

suspending means wound around the first driving sheave and the second driving sheave;

a car suspended by the suspending means, the car being raised and lowered by the first hoisting machine and the second hoisting machine;

a first brake control section for controlling the second brake device and the third brake device; and a second brake control section for controlling the first brake device and the fourth brake device, wherein each of a set of the second brake device and the third brake device and a set of the first brake device and the fourth brake device has a braking force large enough to stop the car by itself, each of the first brake control section and the second brake control section includes a plurality of calculation sections, the plurality of calculation sections are capable of detecting a failure of the plurality of calculation sections by comparing own results of calculations, the first brake control section causes the second brake device and the third brake device to perform a braking operation upon detection of a failure of the plurality of calculation sections, and the second brake control section causes the first brake device and the fourth brake device to perform a braking operation upon detection of a failure of the plurality of calculation sections.

3. An elevator device comprising:

a plurality of hoisting machines including driving sheaves, motors for rotating the driving sheaves, and hoisting machine brakes for braking rotation of the driving sheaves, respectively;

suspending means wound around the driving sheaves;

a car suspended by the suspending means, the car being raised and lowered by the plurality of hoisting machines; and a plurality of brake control sections for controlling the corresponding hoisting machine brakes, respectively, wherein each of the plurality of brake control sections includes a plurality of calculation sections, and the plurality of calculation sections are capable of detecting a failure of the plurality of calculation sections by comparing own results of calculations and cause all of the hoisting machine brakes to perform a braking operation upon detection of the failure of the plurality of calculation sections.

4. An elevator device according to claim 3, further comprising a plurality of electromagnetic switches for turning ON/OFF electric power supply to the hoisting machine brakes, wherein the plurality of electromagnetic switches are connected to each other in series, and upon detection of the failure of the plurality of calculation sections, the plurality of brake control sections turn OFF a corresponding one of the plurality of electromagnetic switches.

5. An elevator device according to claim 3, wherein the plurality of brake control sections are connected to each other through communication means so that communication there between is enabled, and upon detection of the failure of the plurality of calculation sections, one of the plurality of brake control sections transmits failure detection information to another one of the plurality of brake control sections.

* * * * *